US008480262B2

(12) United States Patent
Yu

(10) Patent No.: US 8,480,262 B2
(45) Date of Patent: Jul. 9, 2013

(54) LIGHT PROFILE CONTROLLABLE LIGHT EMITTING DEVICE

(75) Inventor: Hung-Ta Yu, New Taipei (TW)

(73) Assignee: AmTRAN Technology Co., Ltd., New Taipei (TW)

( * ) Notice: Subject to any disclaimer, the term of this patent is extended or adjusted under 35 U.S.C. 154(b) by 159 days.

(21) Appl. No.: 13/207,836

(22) Filed: Aug. 11, 2011

(65) Prior Publication Data

US 2012/0230036 A1 Sep. 13, 2012

(30) Foreign Application Priority Data

Mar. 9, 2011 (TW) ..... 100107990 A

(51) Int. Cl.
*F21V 29/00* (2006.01)
*F21V 1/00* (2006.01)

(52) U.S. Cl.
USPC ..... 362/294; 362/351; 362/373; 362/800

(58) Field of Classification Search
USPC ..... 362/294, 373, 351, 800; 313/46
See application file for complete search history.

(56) References Cited

U.S. PATENT DOCUMENTS

| | | | | |
|---|---|---|---|---|
| 6,712,128 | B1 * | 3/2004 | Dussinger et al. | 165/80.3 |
| 7,144,135 | B2 * | 12/2006 | Martin et al. | 362/294 |
| 7,144,140 | B2 * | 12/2006 | Sun et al. | 362/373 |
| 7,758,223 | B2 | 7/2010 | Osawa et al. | |
| 7,874,710 | B2 * | 1/2011 | Tsai et al. | 362/373 |
| 8,109,661 | B2 * | 2/2012 | Chien et al. | 362/373 |
| 8,115,395 | B2 * | 2/2012 | Horng et al. | 315/117 |
| 8,256,926 | B2 * | 9/2012 | Louh | 362/294 |
| 8,299,695 | B2 * | 10/2012 | Simon et al. | 313/318.01 |
| 2008/0055909 | A1 | 3/2008 | Li | |
| 2008/0174247 | A1 | 7/2008 | Yu et al. | |
| 2009/0195186 | A1 * | 8/2009 | Guest et al. | 315/294 |
| 2012/0217861 | A1 * | 8/2012 | Soni | 313/46 |

* cited by examiner

*Primary Examiner* — Alan Cariaso
(74) *Attorney, Agent, or Firm* — Muncy, Geissler, Olds & Lowe, PLLC

(57) ABSTRACT

A light emitting device includes a body, and a lampshade, a heat dissipation device and an adjusting plate are disposed on the body. The lampshade covers a light emitting diode (LED) module of the body and is capable of rotating relative to the body. The heat dissipation device has a plurality of heat dissipation fins covering a part of a lower edge of the lampshade, and a gap exists between two adjacent heat dissipation fins. The adjusting plate corresponds to the lower edge of the lampshade, and can be driven by the lampshade to adjust the width of the gap, so as to control a light profile generated by the light emitting device.

7 Claims, 3 Drawing Sheets

LIGHT PROFILE CONTROLLABLE LIGHT EMITTING DEVICE

CROSS-REFERENCE TO RELATED APPLICATIONS

This non-provisional application claims priority under 35 U.S.C. §119(a) on Patent Application No(s). 100107990 filed in Taiwan, R.O.C. on Mar. 9, 2011, the entire contents of which are hereby incorporated by reference.

BACKGROUND

1. Technical Field

The present invention relates to a light emitting device, and more particularly to a light emitting diode (LED) light bulb.

2. Related Art

Compared with a conventional incandescent light bulb, an LED, when being in use, is capable of generating light of high brightness and only consumes little electric energy. Furthermore, the LED has advantages of low driving voltage, high response speed and long life time. Therefore, LEDs are widely used for replacing lighting devices such as fluorescent lamps, ceiling lamps, search lights, down lamps and conventional light bulbs.

Generally, an LED light bulb is designed to mainly include a heat-dissipating body on which a pedestal and a connection base are disposed. The pedestal is provided with a circuit board, and a plurality of LEDs are disposed on the circuit board by a surface mounting technology (SMT), and then, a bulb-shaped lampshade is disposed on the pedestal for covering the plurality of LEDs, so as to form a light bulb structure. A drive circuit electrically connected to the LEDs is disposed inside the connection base, and the out surface of the connection base has a spiral conductive portion. The spiral conductive portion is used for being fastened to a lamp socket, so as to be electrically connected to an external power supply, and, therefore a power supply can transfer the electricity through the conductive portion and the drive circuit to the LEDs.

In operation, the great deal of heat generated by the LED would accumulate in the circuit board, overheat the LED and, therefore, cause problems such as significant light attenuation, decrement of life time and reducing efficiency. To prevent such problems, a usual way is to dispose a plurality of heat dissipation fins on the heat-dissipating body. The heat dissipation fins surround the surface of the heat-dissipating body, and a gap exists between two adjacent heat dissipation fins. Such gaps are used as a heat-dissipating channel for air circulation. Furthermore, in order to increase the surface area of the heat dissipation fins for dissipating heat, usually a considerable number of heat dissipation fins are arranged on the heat-dissipating body, and the side edge of the heat dissipation fin having a smaller contact area is connected to the heat-dissipating body. Accordingly, the heat dissipation fins have larger surface areas in the heat-dissipating channel for heat exchange.

However, as the number of the heat dissipation fins increases, the width of the heat-dissipating channel becomes narrower, so that the heat cannot be removed to the external environment due to poor heat convection. As a result, the heat-dissipating efficiency of the heat-dissipating body is reduced, or even worse, the heat-dissipating body loses the heat-dissipating ability.

Currently, in the LED light bulb provided with the heat dissipation fins, in order to effectively cool the bulb, a recess is usually formed on the surface of the heat-dissipating body, and the heat dissipation fins are annularly disposed on the outer surface of the heat-dissipating body and corresponding to the recess. The lampshade is engaged in the recess, and only an upper surface of the lampshade is exposed outside the heat-dissipating body. Accordingly, the light generated by the LED can be projected to the external environment through the lampshade; and the lampshade is surrounded by the heat dissipation fins, so that a better heat-dissipating effect is provided. Although such configuration can improve the heat-dissipating efficiency, the light is blocked by the inner wall surface of the recess after penetrating the lampshade. Therefore, the LED light bulb only has an output light profile in which light is output substantially in a single direction and is not suitable for being applied to a lighting apparatus with a wide illuminating angle.

In another kind of LED light bulb, in order to provide an output light profile of a wide illuminating angle (such as, a 120-degree angle), the circuit board and the LEDs are disposed on the surface of the heat-dissipating body, and the heat dissipation fins are disposed on the side surface of the heat-dissipating body adjacent to the circuit board. Therefore, when the LEDs and the circuit board are covered by the lampshade, the lampshade is located at the surface of the heat-dissipating body, and the heat dissipation fins surround the outer periphery of the heat-dissipating body and are located below the lampshade, so as to prevent the heat dissipation fins from covering the lower edge surface of the lampshade and causing interference to the output light profile of the LED light bulb. Although this kind of LED light bulb can have an output light profile with about a 120-degree angle, the heat dissipation fins cannot directly dissipate heat from the surface of the lampshade and therefore, the heat-dissipating ability is limited.

In the LED light bulbs in the prior art, no matter which configuration is adopted for the heat dissipation fins, the light bulb structure formed thereby only has a single output light profile. Therefore, the output light profile of the LED light bulb cannot be adjusted according to requirements in use, so that the application of the LED light bulb to different lighting apparatuses is greatly limited.

SUMMARY

Accordingly, the present invention provides a light emitting device for improving the problems in the prior art that the output light profile of the LED light bulb cannot be adjusted in use, and that the LED light bulb has to sacrifice heat-dissipating ability in order to provide an output light profile of a wide illuminating angle.

According to an embodiment of the present invention, a light emitting device comprises a body, a lampshade, a heat dissipation device and an adjusting plate. The body has an LED module, and the lampshade covers the LED module. The heat dissipation device is disposed on the body, and has a plurality of heat dissipation fins covering a part of a lower edge of the lampshade. A gap exists between two adjacent heat dissipation fins. The adjusting plate is capable of rotating relative to the body to adjust the width of the gap, so as to control a light profile generated by the light emitting device.

In the light emitting device according to the present invention, the output light profile of light generated by the LEDs can be adjusted through the relative rotation of the adjusting plate with respect to the heat dissipation fins, and therefore, the light emitting device can be applied to different light fixtures in accordance with actual requirements in use. Moreover, the heat dissipation fins cover the lower edge of the lampshade, so that the light emitting device not only can adjust the output light profile, but also can maintain the efficiency of heat dissipation provided by the heat dissipation device for the LED module. Therefore, compared with the LED light bulbs in the prior art, the light emitting device according to the present invention has advantages of having an adjustable output light profile and excellent heat-dissipating efficiency.

BRIEF DESCRIPTION OF THE DRAWINGS

The present invention will become more fully understood from the detailed description given herein below for illustration only, and thus are not limitative of the present invention, and wherein.

DETAILED DESCRIPTION

The detailed features and advantages of the present invention are described below in great detail through the following embodiments, the content of the detailed description is sufficient for those skilled in the art to understand the technical content of the present invention and to implement the present invention there accordingly. Based upon the content of the specification, the claims, and the drawings, those skilled in the art can easily understand the relevant objectives and advantages of the present invention. The following embodiments are intended to describe the present invention in further detail, but not intended to limit the scope of the present invention in any way.

Figure 1:
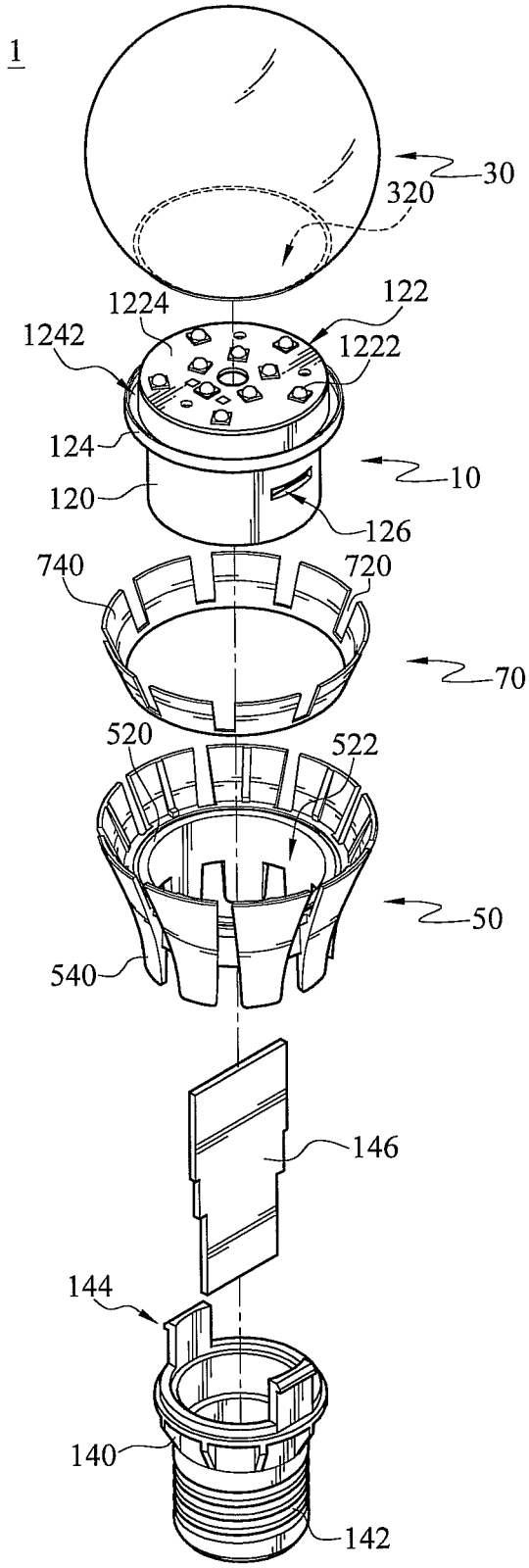
FIG. 1 is a schematic exploded view of an embodiment of the present invention.
Figure 2:
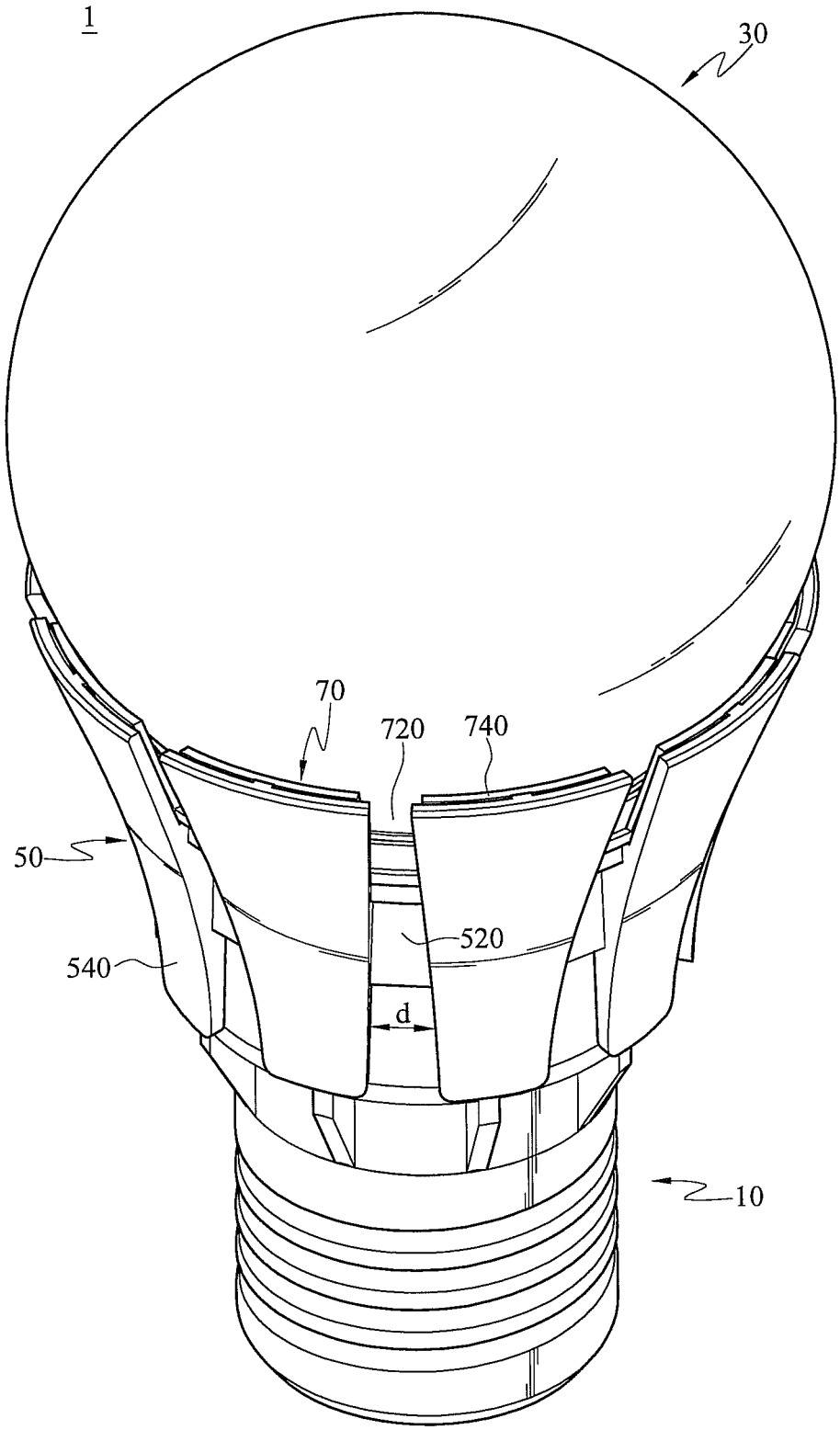
FIG. 2 is a schematic assembled view of an embodiment of the present invention.

As shown in FIG. 1 and FIG. 2, a light emitting device 1 according to an embodiment of the present invention comprises a body 10, a lampshade 30, a heat dissipation device 50 and an adjusting plate 70. The body 10 comprises a pedestal 120 and a connection base 140. The pedestal 120 is made of a material with good thermal conductivity, such as aluminum and copper, and is used as a main conductive column for conducting heat. An LED module 122 is disposed on one side surface of the pedestal 120. The LED module 122 comprises at least one LED 1222 disposed on and electrically connected to a circuit board and a reflector 1224 on the circuit board. The reflector 1224 has a through hole corresponding to the LED 1222, so that the LED 1222 protrudes from the reflector 1224 through the through hole. At least one stop portion 124 is disposed on the pedestal 120. Although a single stop portion 124 may be disposed on the pedestal 120 and surrounds a surface of the pedestal 120, or a plurality of stop portions 124 may be disposed at intervals on the surface of the pedestal 120, the present invention is not limited thereto. Moreover, the pedestal 120 is further provided with at least one fastening portion 126. The fastening portion 126 is disposed on the other side of the stop portion 124 opposite to the LED module 122, and the fastening portion 126 is used for combining the connection base 140 with the pedestal 120. The fastening portion 126 may be, but is not limited to, two fillisters 126 disposed at two opposite sides of the pedestal 120, and the two fillisters may pass through the inner surface of the pedestal 120 alternatively (as shown in FIG. 1). Or, the fastening portion 126 may be, but is not limited to, a groove annularly disposed on the inner surface of the pedestal 120 without passing through the side wall of the pedestal 120 (not shown). It is intended to illustrate that the fastening portion 126 is disposed on the pedestal 120 in different manners without limiting the present invention.

The connection base 140 has a conductive portion 142 and a buckle element 144. The conductive portion 142 and the buckle element 144 are respectively disposed at two opposite ends of the connection base 140. The conductive portion 142 has a thread for being screwed to a lamp socket (not shown) for electrically connecting to a power supply. The buckle element 144 corresponds to the fastening portion 126 of the pedestal 120. The connection base 140 is connected to the pedestal 120 through the combination of the fastening portion 126 with the buckle element 144 to form the body 10 of the light emitting device 1. As shown in FIG. 1, when the fastening portion 126 of the pedestal 120 is two fillisters, the buckle element 144 of the connection base 140 adopts the form of two corresponding hooks for being disposed on the connection base 140. And when the connection base 140 is connected to the pedestal 120, the buckle element 144 is fastened to the fastening portion 126 from the inner surface of the pedestal 120, so as to maintain the outer surface of the pedestal 120 neat. Therefore, other components (such as the heat dissipation device 50 and the adjusting plate 70) can be easily disposed on the surface of the pedestal 120. Moreover, a circuit module 146 is disposed inside the connection base 140 and comprises a drive circuit and other electric components (not shown), such as a capacitor and a resistor. The circuit module 146 is electrically connected to the LED module 122 to drive the LED 1222 to generate light.

The lampshade 30 may be, but is not limited to, a light-transmissive bulb-shaped lampshade made of glass or plastic materials. The lampshade 30 has an opening 320. The lampshade 30 covers the pedestal 120 of the body 10 through the opening 320, so that the LED module 122 is enclosed inside the lampshade 30. Therefore, the light generated by the LED module 122 passes through the lampshade 30 to propagate to external environment and generates a light profile in external environment. The lampshade 30 abuts on the stop portion 124 of the pedestal 120, and a groove 1242 is formed on one side surface of the stop portion 124 adjacent to the LED module 122. The lampshade 30 is embedded and engaged in the groove 1242 through one side edge adjacent to the opening 320, and is capable of rotating around the groove 1242, so that the lampshade 30 can rotate relative to the pedestal 120.

The heat dissipation device 50 and the adjusting plate 70 are also disposed on the pedestal 120 of the body 10, and located at the other side of the stop portion 124 opposite to the LED module 122. The heat dissipation device 50 is also made of a material with good thermal conductivity, and comprises a sleeve portion 520 and a plurality of heat dissipation fins 540. The sleeve portion 520 has a through hole 522, the sleeve portion 520 sleeves the pedestal 120 through the through hole 522, and an inner surface of the sleeve portion 520 approximates to the surface of the pedestal 120. The diameter of the through hole 522 of the sleeve portion 520 is smaller than the outer diameter of the stop portion 124 and the outer diameter of one side edge of the connection base 140 adjacent to the buckle element 144. Therefore, when sleeving the pedestal 120, the sleeve portion 520 is engaged between the stop portion 124 of the pedestal 120 and the connection base 140, so that the heat dissipation device 50 is fixed to the body 10.

The heat dissipation fins 540 are disposed at intervals on the outer surface of the sleeve portion 520, and a gap d exists between two adjacent heat dissipation fins 540. The gap d forms a heat-dissipating channel on the heat dissipation device 50. The heat dissipation fins 540 are disposed on the outer surface of the sleeve portion 520 and surround the lampshade 30. The opposite ends of the heat dissipation fins 540 are respectively suspended above the side surface of the pedestal 120. Besides, one end of each heat dissipation fin 540 covers a part of a lower edge of the lampshade 30 (that is, one side surface of the lampshade 30 adjacent to the stop portion 124). The width of the heat dissipation fin 540 is equal to or larger than the width of the gap d, and the width of the heat dissipation fin 540 gradually shrinks from one end close to the lampshade 30 to the other end away from the lampshade 30. Therefore, by suspending the heat dissipation fins 540 above the surface of the pedestal 120, an air convection space exists between the heat dissipation fins 540 and the surface of the pedestal 120 to enhance the heat exchange between hot air and outside cold air. In addition, the heat dissipation fins 540 are suspended above the surface of the pedestal 120 with a surface having a large area, so that the heat exchange is improved. Accordingly, the efficiency of heat dissipation of the heat dissipation device 50 acting on the LED module 122 is improved. Moreover, in other embodiments of the present invention, a layer of coating (not shown) capable of improving heat radiation may be applied on both the surfaces of the pedestal 120 and the heat dissipation device 50 for further improving the heat dissipation ability of the light emitting device 1.

The adjusting plate 70 may be, but is not limited to be, made of a material with both good thermal conductivity and elasticity. For example, the adjusting plate 70 is a ring made of copper or aluminum. The adjusting plate 70 is sleeved between the lampshade 30 and the heat dissipation device 50. The inner diameter of the adjusting plate 70 gradually shrinks from one side close to the lampshade 30 to the other side close to the heat dissipation device 50, and the inner diameter of one side of the adjusting plate 70 close to the heat dissipation device 50 is smaller than the outer diameter of the stop portion 124. Therefore, when the adjusting plate 70 sleeves the pedestal 120, one side of the adjusting plate 70 abuts against the stop portion 124, and the other side of the adjusting plate 70 corresponds to the lower edge of the lampshade 30 and is connected to the surface of the lampshade 30. Therefore, when the lampshade 30 rotates relative to the pedestal 120, the adjusting plate 70 can be driven by the lampshade 30 to rotate between the pedestal 120 and the heat dissipation fins 540.

Figure 3:
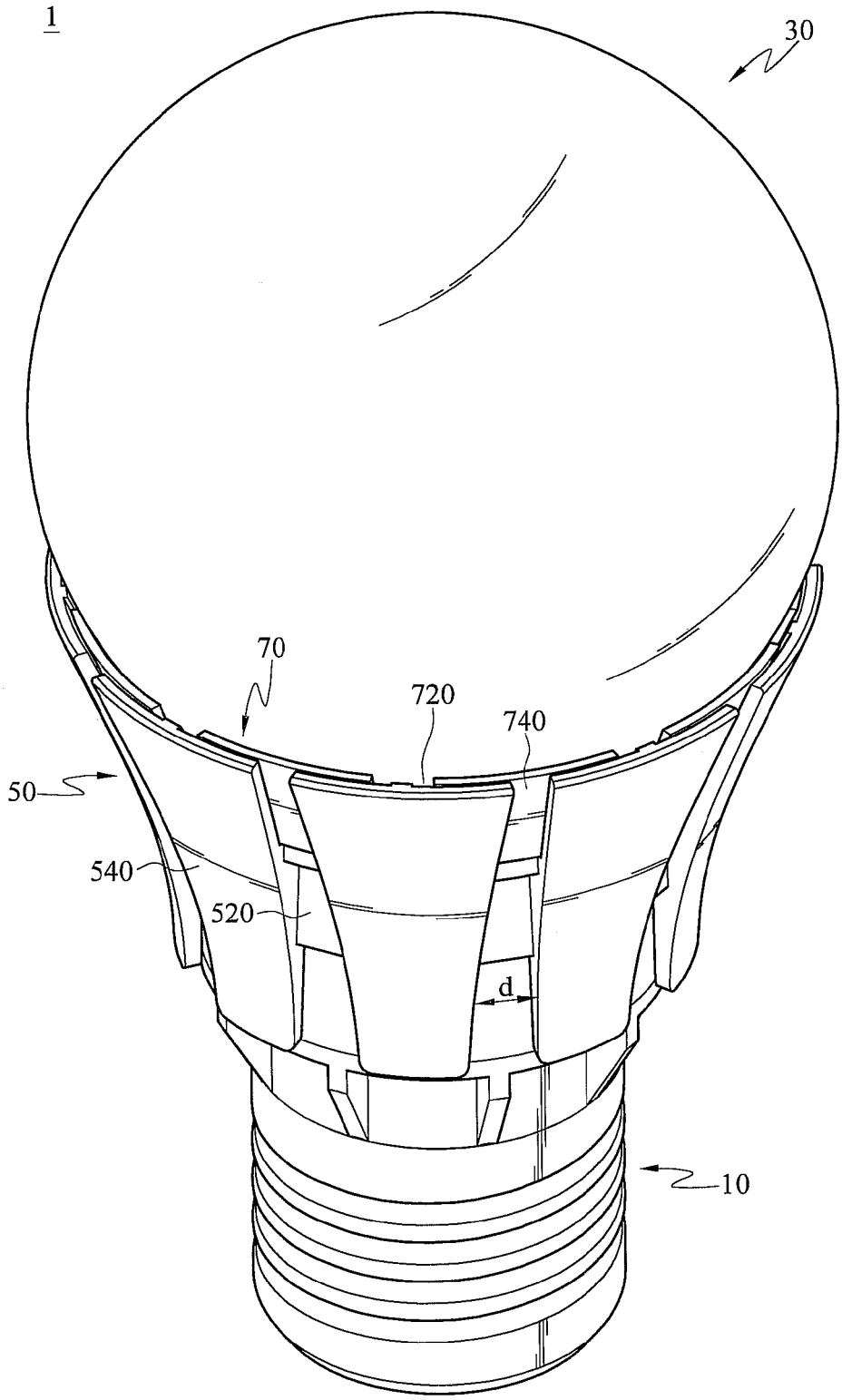
FIG. 3 is a schematic view illustrating operation of an embodiment of the present invention.

Moreover, a side edge of the adjusting plate 70 has at least one concave 720. The number of the concaves 720 is corresponding to the number of the gaps d between the heat dissipation fins 540. The concaves 720 are arranged along the side edge of the adjusting plate 70 and a plurality of flexible strips 740 is formed on the adjusting plate 70. The widths of the concave 720 and the flexible stripe 740 respectively correspond to the widths of the gap d and the heat dissipation fin 540. Therefore, when the concave 720 is completely aligned with the gap d of the heat dissipation device 50 as the adjusting plate 70 is rotated, the flexible stripe 740 is covered between the lampshade 30 and the heat dissipation fins 540, and does not cover the gap d, so that the light transmitted through the lampshade 30 can propagate to the external environment through the gap d, and thereby, the light emitting device 1 has a light profile of a 150-degree light emitting angle. On the contrary, as shown in FIG. 3, when the flexible strip 740 is completely aligned with the gap d of the heat dissipation device 50 as the adjusting plate 70 is rotated (that is, the concave is completely covered between the lampshade 30 and the heat dissipation fins 540), the gap d is covered by the flexible strip 740, so that the light is blocked from propagating to the external environment through the gap d, thereby the light emitting angle of the light emitting device 1 is limited to a 90-degree light profile.

Therefore, in the light emitting device 1 according to the present invention, the light emitting angle of the light emitting device 1 can be adjusted by adjusting the area of the gap d covered by the flexible strip 740, so that the output light profile can be freely adjusted between 90 to 150 degrees. Accordingly, the light emitting device 1 is applicable to upward-projection or downward-projection light fixtures. For example, the output light profile of the light emitting device 1 can be adjusted to 90 degrees by rotating the adjusting plate 70, so as to be applied to a down lamp; or the output light profile of the light emitting device 1 can be adjusted to 150 degrees by rotating the adjusting plate 70, so as to be applied to a ceiling lamp or a wall lamp.

Moreover, the light emitting device 1 according to the present invention not only has the function of adjustable output light profile, but also has good heat-dissipating effect. The following Table 1 shows test results of the heat-dissipating efficiency of the light emitting device 1 according to the present invention and the LED light bulb in the prior art.

TABLE 1

| | Input power (Watt, W) | Temperature (° C.) Circuit board of the LED module Center | Edge | Light emitting device Surface of the body | Ambient environment |
|---|---|---|---|---|---|
| The present invention | 10.5 | 92.1 | 83.2 | 75.6 | 23.7 |
| The prior art | 10.5 | 102.0 | 97.0 | 90.0 | 24.0 |

As shown in Table 1, through the heat dissipation device 50 disposed on the body 10, the light emitting device 1 according to the present invention can reduce the temperature of the center of the circuit board in the LED module 122 by about 10° C., and can more effectively reduce the temperature of the edge of the circuit board by at least 10° C.

Therefore, compared with the LED light bulb in the prior art, the light emitting device 1 according to the present invention can be supplied with a higher current input power and can prevent the LED module 122 from being burned out or deterioration of the luminous efficiency due to being overheated. Moreover, as shown in the test results of the surface temperature of the body 10 of the light emitting device 1, the temperature can be lowered by about 25° C. Such temperature decrease can not be achieved by the LED light bulb in the prior art.

Meanwhile, it can be seen from data shown in Table 1 that, in addition to that the light emitting device 1 according to the present invention has a better heat-dissipating effect, the temperature of the ambient environment of the light emitting device 1 does not rise as the temperature of the light emitting device 1 drops. Therefore, when being in operation, the light emitting device 1 according to the present invention does not lead to the rise of the temperature of the ambient environment. Accordingly, when being used for indoor lighting, the light emitting device 1 according to the present invention does not lead to the rise of the indoor temperature, and in turn, the temperature of the light emitting device 1 will not rise due to the influence of the indoor temperature, thereby enabling the light emitting device 1 to maintain a stable luminous efficiency.

In the light emitting device according to the present invention, the lower edge of the lampshade is covered by the heat dissipation fins, and the adjusting plate is located between the heat dissipation fins and the lampshade and is capable of rotating relative to the heat dissipation fins, so that the light emitting device can adjust the output light profile by rotating the adjusting plate, and thus is applicable to different light fixtures and has high practicability. Moreover, by making the heat dissipation fins at a distance from the surface of the body, an air convection space is additionally formed between the heat dissipation fins and the body. Such air convection space facilitates heat exchange of the heat energy generated by the LED module in the air convection space, thereby greatly improving the heat-dissipation ability of the heat dissipation device for the LED module.

What is claimed is:

1. A light emitting device, comprising:

a body, having a light emitting diode (LED) module;

a lampshade, covering the LEI) module;

a heat dissipation device, disposed on the body, wherein the heat dissipation device has a plurality of heat dissipation fins, the plurality of heat dissipation fins covers a part of a lower edge of the lampshade, and a gap exists between two adjacent heat dissipation fins; and an adjusting plate, capable of rotating relative to the body for adjusting the width of the gap, the adjusting plate being sleeved on the body and located between the lampshade and the heat dissipation device, one side of the adjusting plate being connected to the lampshade, and the other side being in contact with a surface of the body.

2. The light emitting device according to claim 1, wherein the body has a pedestal and a connection base, the LED module is disposed on one side of the pedestal, the connection base is detachably connected to the other side of the pedestal opposite to the LED module, and a conductive portion is disposed on the connection base.

3. The light emitting device according to claim 2, wherein the pedestal has at least one fillister, the connection base has at least one buckle element, the connection base is connected to the pedestal, and the at least one buckle element is engaged in the fillister.

4. The light emitting device according to claim 2, wherein a circuit module is disposed in the connection base and electrically connected to the LED module.

5. The light emitting device according to claim 1, wherein the heat dissipation device further has a sleeve portion, the sleeve portion is sleeved on the body, and the plurality of heat dissipation fins are disposed at intervals on a surface of the sleeve portion and suspended above a surface of the body.

6. The light emitting device according to claim 1, wherein the body further has at least one stop portion, the at least one stop portion surrounds a surface of the body, and the lampshade and the heat dissipation device are respectively disposed at two opposite sides of the stop portion.

7. The light emitting device according to claim 6, wherein the stop portion has a groove, and one side edge of the lampshade is embedded in the groove.

* * * * *